US009548540B2

(12) United States Patent
Hsu

(10) Patent No.: US 9,548,540 B2
(45) Date of Patent: Jan. 17, 2017

(54) SLOT ANTENNA

(71) Applicant: Chiun Mai Communication Systems, Inc., New Taipei (TW)

(72) Inventor: Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 71 days.

(21) Appl. No.: 14/585,375

(22) Filed: Dec. 30, 2014

(65) Prior Publication Data

US 2016/0104938 A1 Apr. 14, 2016

(30) Foreign Application Priority Data

Oct. 13, 2014 (CN) ..... 2014 1 0537600

(51) Int. Cl.
*H01Q 13/10* (2006.01)

(52) U.S. Cl.
CPC ..... *H01Q 13/106* (2013.01)

(58) Field of Classification Search
CPC ..... H01Q 13/10; H01Q 13/106
USPC ..... 343/767, 770
See application file for complete search history.

(56) References Cited

U.S. PATENT DOCUMENTS 8,947,310 B2 * 2/2015 Cheng ..... H01Q 13/10 343/770
8,982,005 B2 * 3/2015 Tu ..... H01Q 13/10 343/767
2014/0354496 A1 * 12/2014 Hwang ..... H01Q 1/243 343/770

FOREIGN PATENT DOCUMENTS

TW 201301664 A1 1/2013
TW 201322549 A1 6/2013
TW 201411936 A 3/2014
TW 201427172 A 7/2014

* cited by examiner

*Primary Examiner* — Hoang V Nguyen
(74) *Attorney, Agent, or Firm* — Zhigang Ma

(57) ABSTRACT

A slot antenna includes a dielectric substrate, a conductive layer, a slot and a feeding strip. The dielectric substrate includes a first surface and a second surface opposite the first surface. The conductive layer is positioned on the first surface of the dielectric substrate, and is configured to electronically couple to ground. The slot is defined in the conductive layer and terminates on an edge of the conductive layer. The feeding strip is positioned on the second surface of the dielectric substrate and extends across the slot. The feeding strip is configured to feed current signal and resonate with the conductive layer.

12 Claims, 9 Drawing Sheets

SLOT ANTENNA

FIELD

The subject matter herein generally relates to antenna structures, and particularly to a slot antenna.

BACKGROUND

With improvements in the integration of wireless communication systems, antennas have become increasingly important. For a wireless communication device to utilize various frequency bandwidths, antennas having wider bandwidths have become a significant technology.

BRIEF DESCRIPTION OF THE DRAWINGS

Implementations of the present technology will now be described, by way of example only, with reference to the attached figures.

DETAILED DESCRIPTION

Figure 1:
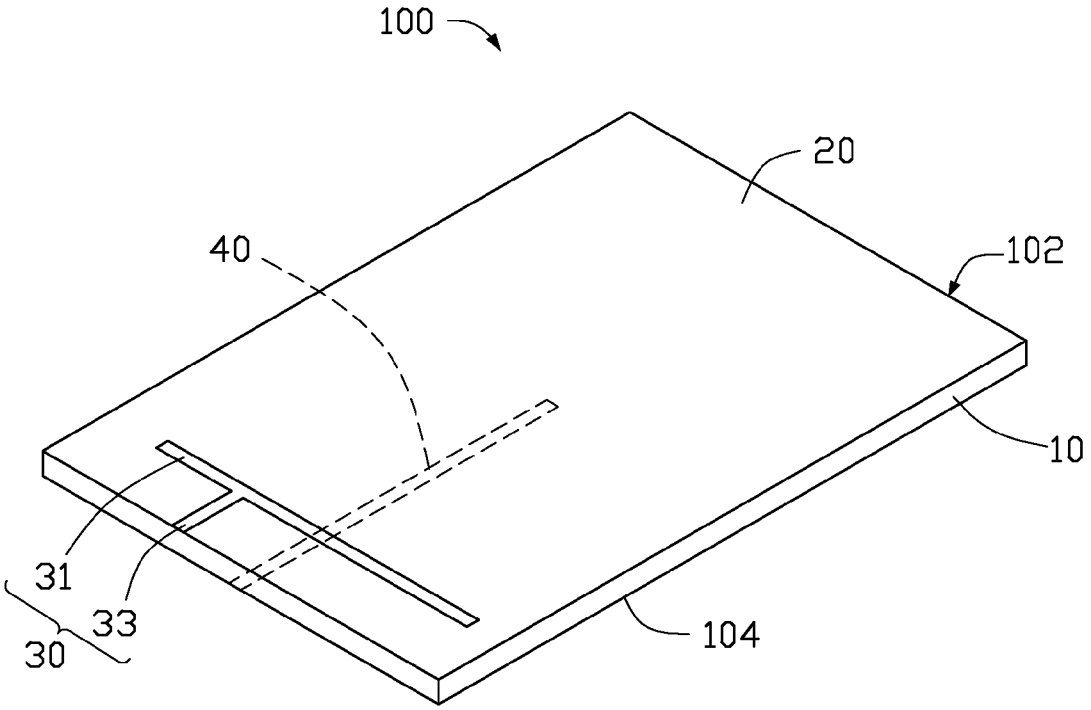
FIG. 1 is an isometric view of a first embodiment of a slot antenna.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an isometric view of a first embodiment of a slot antenna 100. The slot antenna 100 can be used in wireless communication devices, such as mobile phone, and tablet computer, for sending/receiving wireless signals. The slot antenna 100 includes a dielectric substrate 10, a conductive layer 20, a slot 30, and a feeding strip 40. The dielectric substrate 10 includes a first surface 102 and a second surface 104 opposite to the first surface 102. The conductive layer 20 is positioned on the first surface 102, and is configured to electronically couple to ground. In another words, the conductive layer 20 is a ground layer being formed from a conductive material. The slot 30 is defined in the conductive layer 20 where the conductive material is missing, and terminates on an edge of the conductive layer 20. The feeding strip 40 is positioned on the second surface 104 of the dielectric substrate 10, and extends across the slot 30. The feeding strip 40 is configured to feeding current signals and resonates with the conductive layer 20 to generate a low frequency resonate mode and a high frequency resonate mode.

In at least one embodiment, the dielectric substrate 10 and the conductive layer 20 cooperatively serve as a cover, such a rear cover, of a wireless communication device.

The slot 30 is located at an end of the conductive layer 20, and includes a first sub-slot 31 and a second sub-slot 33 coupled substantially perpendicular to the first sub-slot 31. The slot 30 includes two close-ends, and an open-end. In other words, the first sub-slot 31 is positioned wholly within the conductive layer 20, the second sub-slot 33 is open at an edge of the conductive layer 20.

The feeding strip 40 is substantially a rectangular strip, and is positioned substantially perpendicular to the first sub-slot 31. The feeding strip 40 terminates on an edge of the second surface 104.

Figure 2:
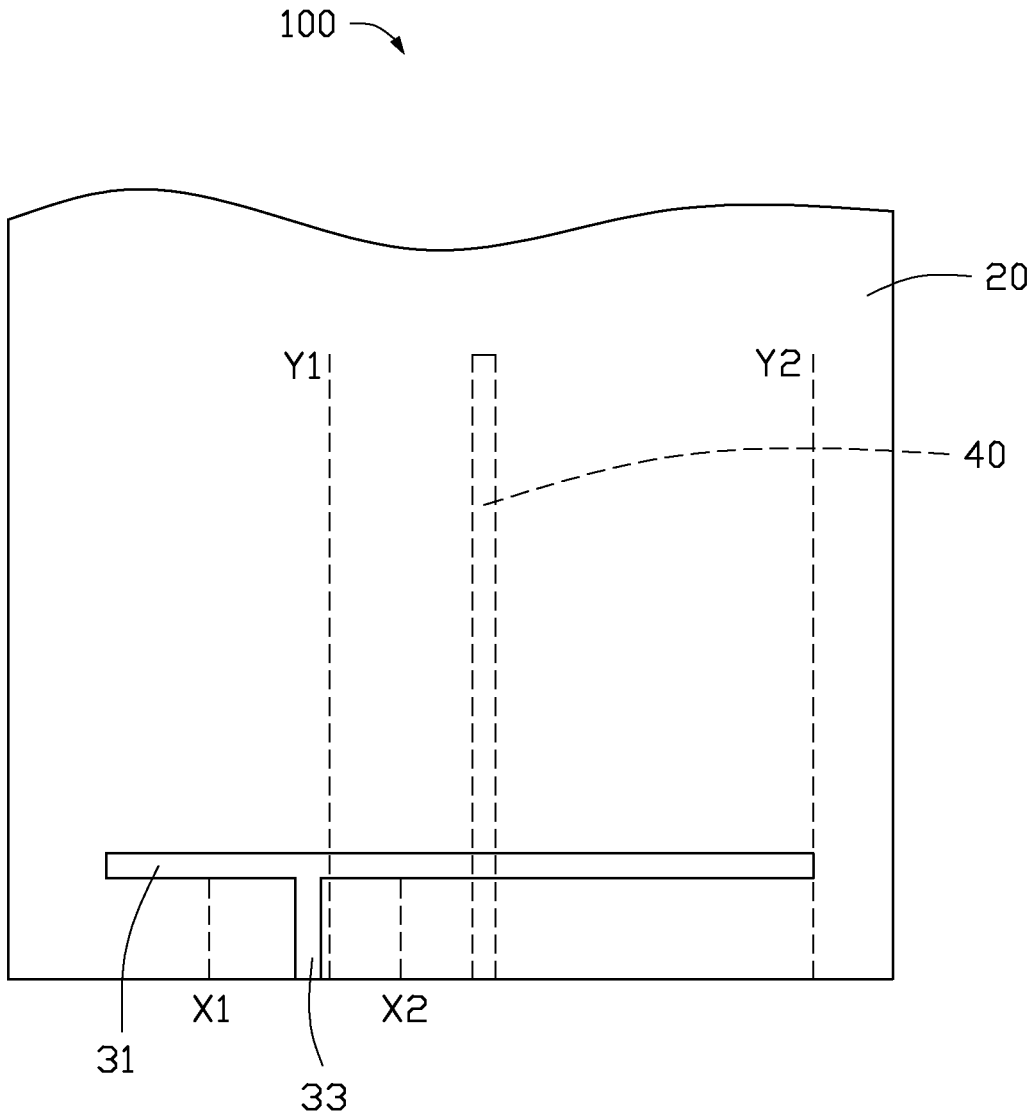
FIG. 2 is a plan view of the slot antenna as shown in FIG. 1.

FIG. 2 illustrates a plan view of the slot antenna 100 as shown in FIG. 1. An operating frequency band and impedance matching of the slot antenna 100 can be regulated by regulating the relative position between the first and second sub-slots 31 and 33. In addition, the impedance matching of the slot antenna 100 can also be regulated by regulating the relative position between the first sub-slot 31 and the feeding strip 40. For example, as illustrated in FIG. 2, the second sub-slot 33 can be positioned at different locations in a region defined between a line X1 and a line X2. Similarly, the feeding strip 40 can be positioned at different locations in a region defined between a line Y1 and a line Y2.

Figure 3:
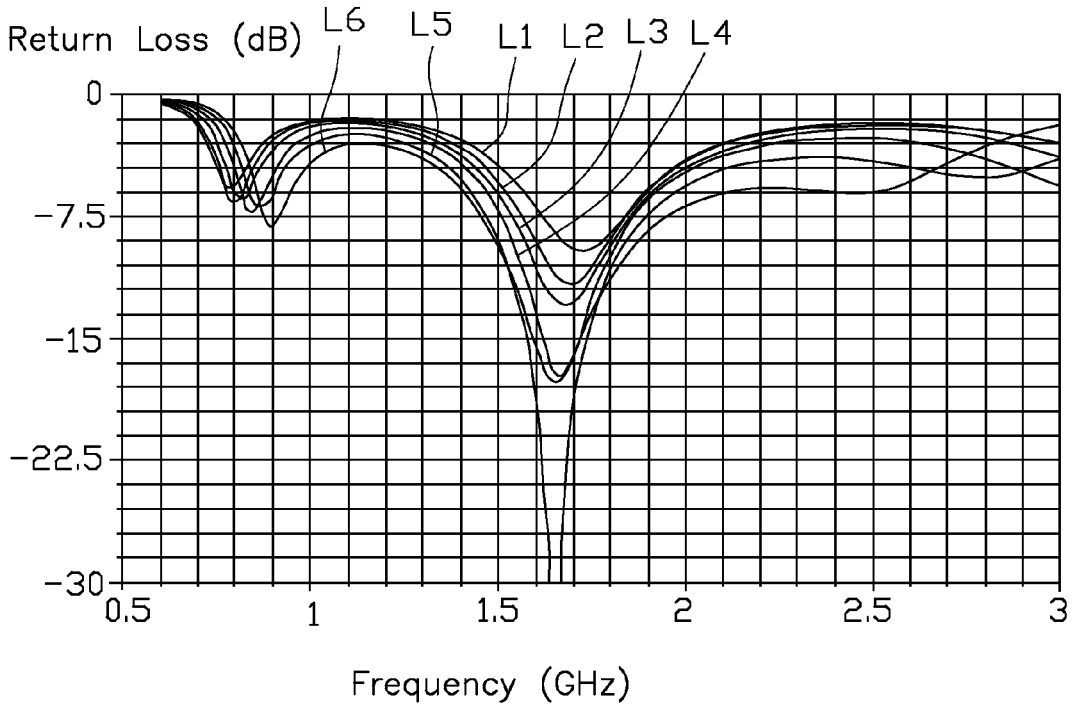
FIG. 3 is a measured return loss ("RL") diagram for explaining a change of the RL of the slot antenna of FIG. 1 in response to a change of a position of a feeding strip of the slot antenna.

FIG. 3 illustrates a measured return loss ("RL") diagram for explaining a change of the RL of the slot antenna 100 as shown in FIG. 1 in response to a change of the position of the feeding strip 40. Curves L1-L6 represent RLs of the slot antenna 100 when the feeding strip 40 is located at six different locations in the region defined between the line Y1 and Y2 as shown in FIG. 2. It can be derived from FIG. 3 that the slot antenna 100 operates at a low frequency band from about 824 MHz to about 960 MHz and a high frequency band from about 1710 MHz to about 2690 MHz. In addition, with the change of the location of the feeding strip 40, the central frequency of the low frequency band and the low frequency band are changed accordingly, thus the bandwidth of the slot antenna 100 is broadened.

Figure 4:
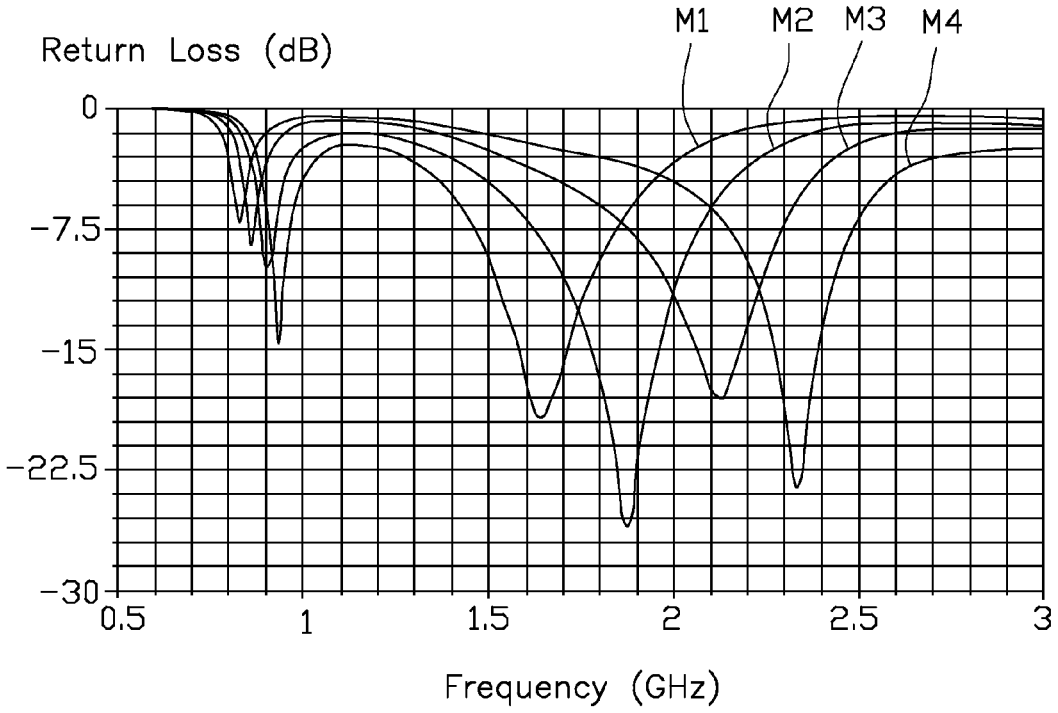
FIG. 4 is a measured return loss ("RL") diagram for explaining a change of the RL of the slot antenna of FIG. 1 in response to a change of a position of a second sub-slot of the slot antenna.

FIG. 4 illustrates a measured return loss ("RL") diagram for explaining a change of the RL of the slot antenna 100 as shown FIG. 1 in response to a change of the position of the second sub-slot 33. Curves M1-M4 represent RLs of the slot antenna 100 when the second sub-slot 33 is located at four different locations in the region defined between the line X1 and X2 as shown in FIG. 2. It can be derived from FIG. 4 that the slot antenna 100 operates at a low frequency band from about 824 MHz to about 960 MHz and a high frequency band from about 1710 MHz to about 2690 MHz. In addition, with the change of the location of the second sub-slot 33, the central frequency of the low frequency band and the low frequency band are changed accordingly, thus the bandwidth of the slot antenna 100 is broadened.

Figure 5:
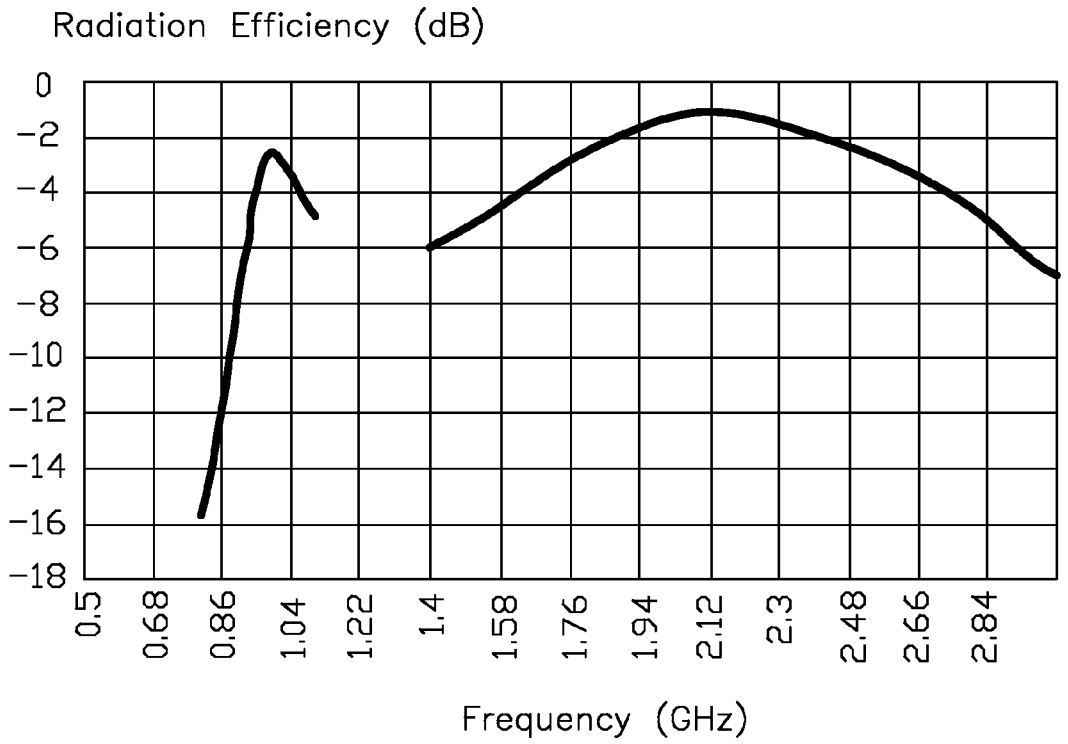
FIG. 5 is a diagram showing radiation efficiency measurement of the slot antenna as shown in FIG. 1.

FIG. 5 illustrates a diagram showing radiation efficiency measurement of the slot antenna 100 as shown in FIG. 1. It can be derived from FIG. 5 that the radiation efficiency of the slot antenna 100 is greater than −6 dB when the slot antenna 100 operates at the low frequency band from about 824 MHz to about 960 MHz and the high frequency band from about 1710 MHz to about 2690 MHz. Accordingly, the slot antenna 100 can be utilized in common wireless communication systems, such as GSM850/EGSM900/DCS1800/PCS1900/UMTS/LTE2300, with an exceptional communication quality.

Figure 6:
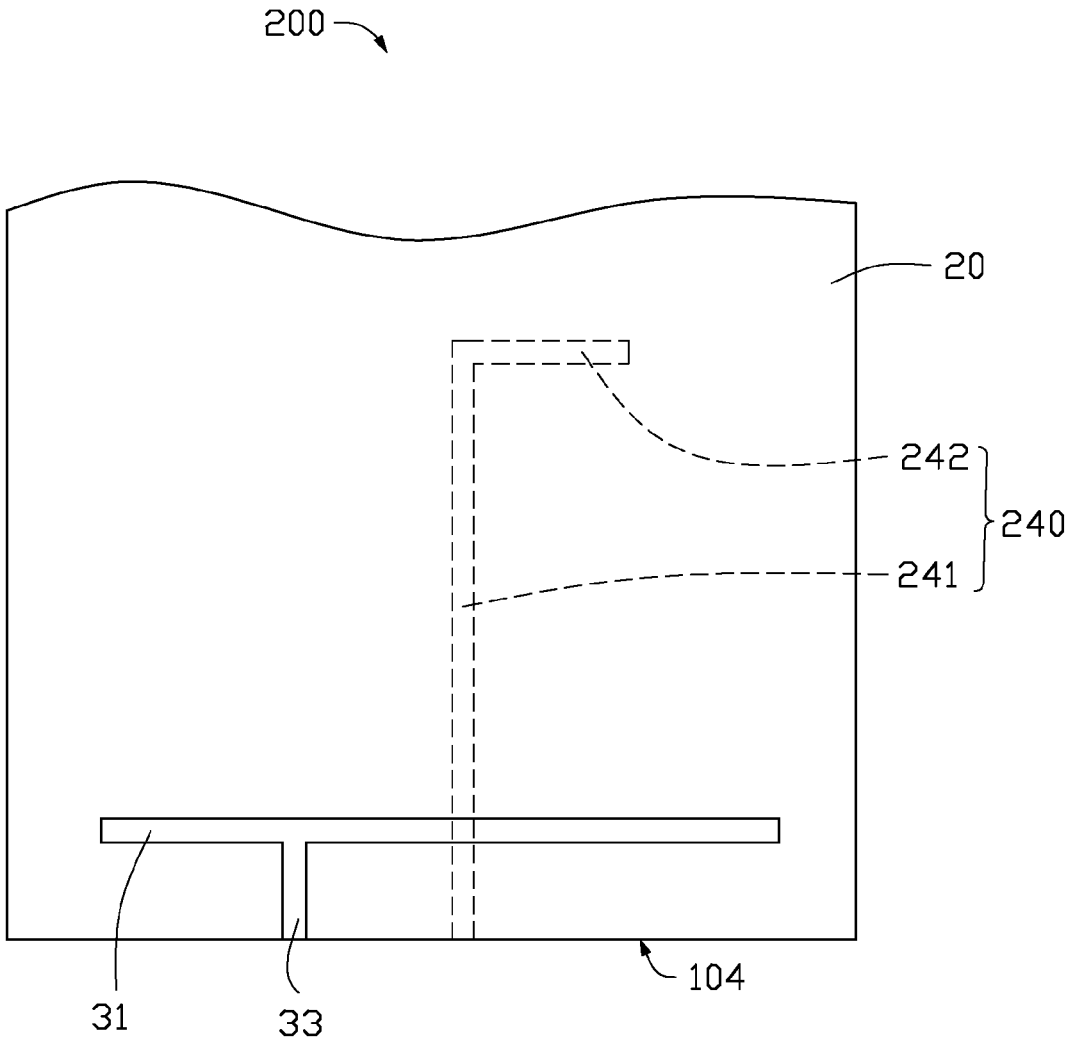
FIG. 6 is a plan view of a second embodiment of a slot antenna.

FIG. 6 illustrates a plan view of a second embodiment of a slot antenna 200. The slot antenna 200 differs from the slot antenna 100 only in that: the slot antenna 200 includes a substantially L-shaped feeding strip 240. The feeding strip 240 includes a first section 241 and a second section 242 extending from the first section 241. The first section 241 is substantially perpendicular to the first sub-slot 31. A distal end of the first section 241 terminates on an edge of the second surface 104. A distal end of the second section 242 is configured to electronically couple to a radio frequency circuit (not shown).

Figure 7:
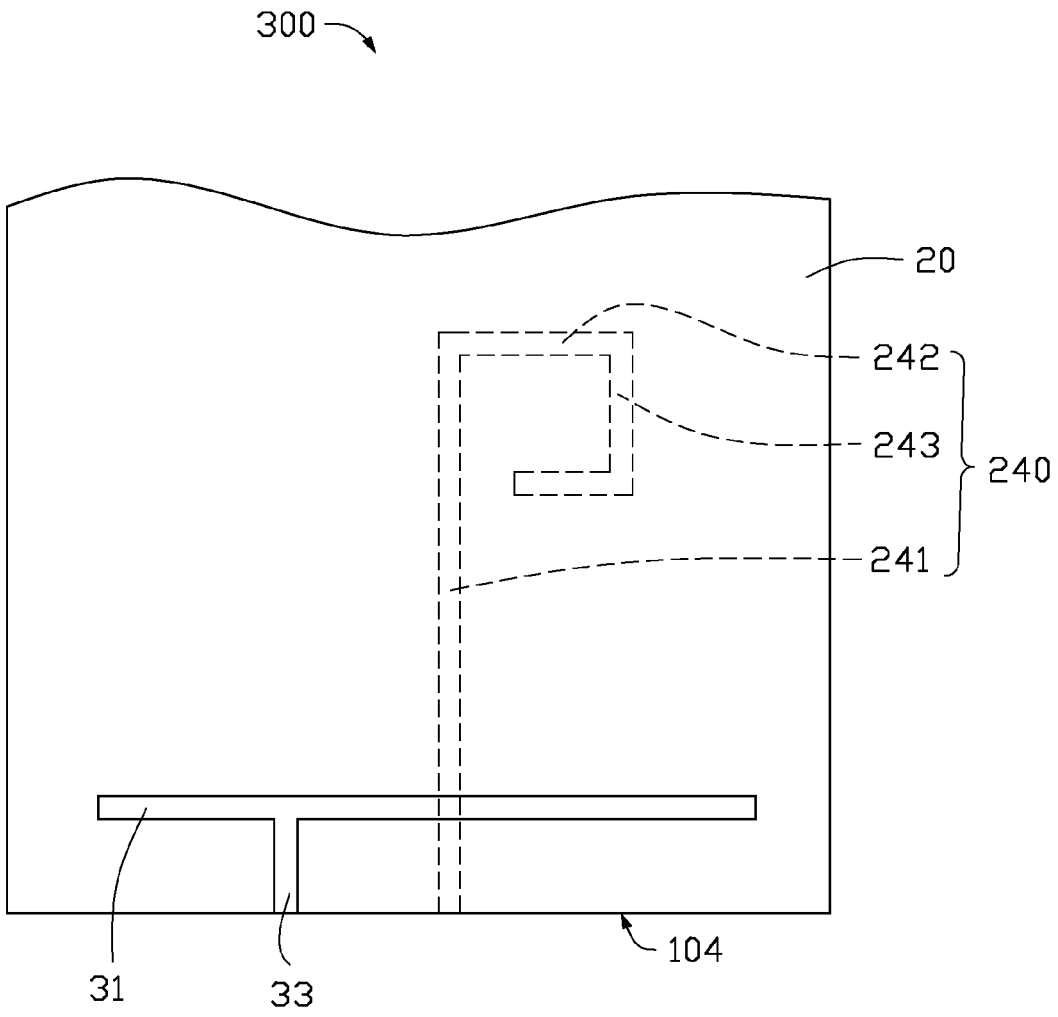
FIG. 7 is a plan view of a third embodiment of a slot antenna.

FIG. 7 illustrates a plan view of a third embodiment of a slot antenna 300. The slot antenna 300 differs from the slot antenna 200 only in that: the feeding strip 240 further includes a third section 243 that is substantially L-shaped, and extends substantially perpendicular from the second section 242.

Figure 8:
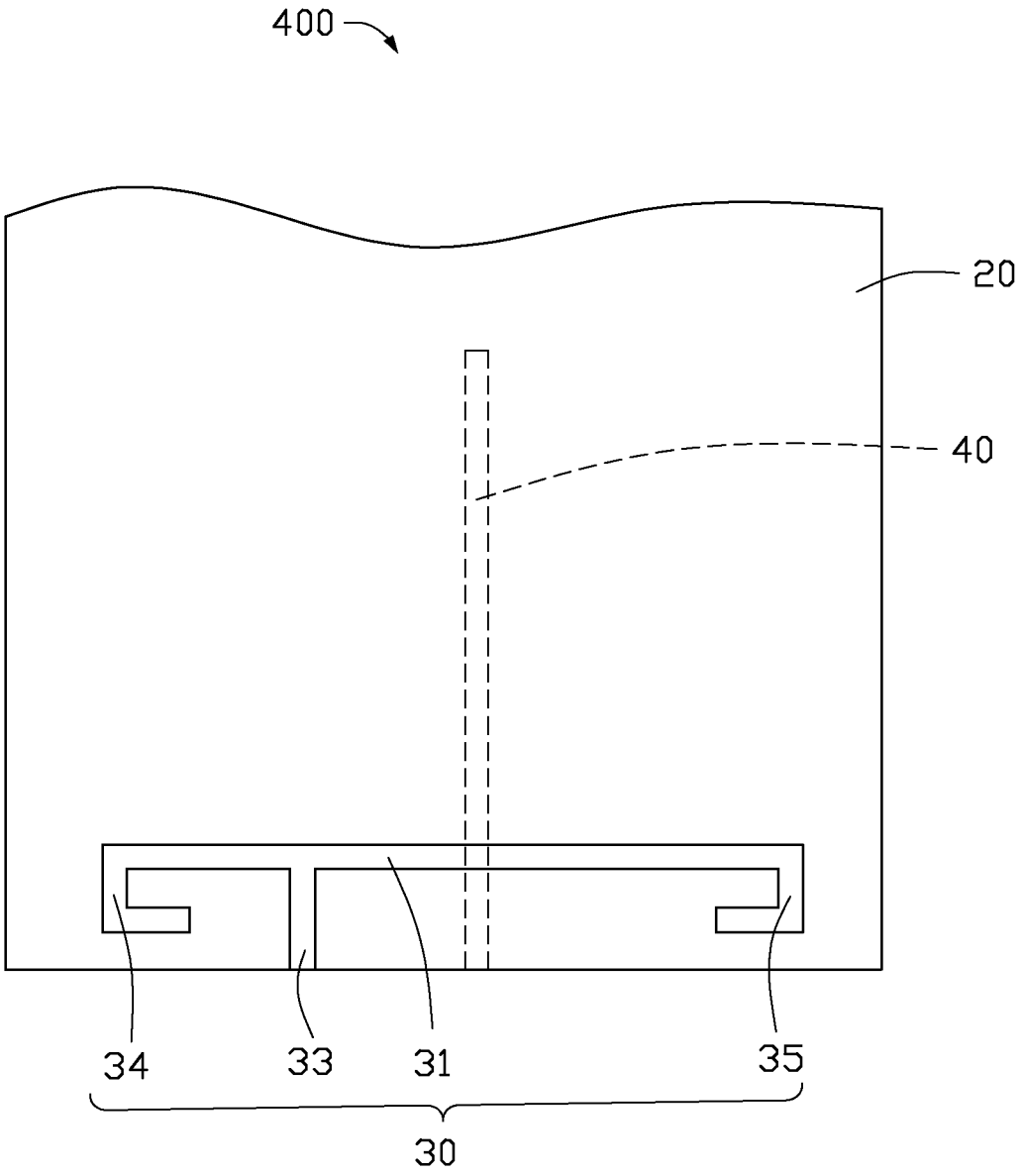
FIG. 8 is a plan view of a fourth embodiment of a slot antenna.

FIG. 8 illustrates a plan view of a fourth embodiment of a slot antenna 400. The slot antenna 400 differs from the slot antenna 100 only in that: the slot 30 further includes a third sub-slot 34 and a fourth sub-slot 35. The third and fourth sub-slots 34 and 35 are coupled to two opposite ends of the first sub-slot 31, respectively. The second, third and fourth sub-slots 33, 34 and 35 are positioned at a same side of the first sub-slot 31. The third and fourth sub-slots 34 and 35 are substantially meander slots. In at least one embodiment, the third and fourth sub-slots 34 and 35 are substantially L-shaped, and are symmetrically located at the two ends of the first sub-slot 31.

Figure 9:
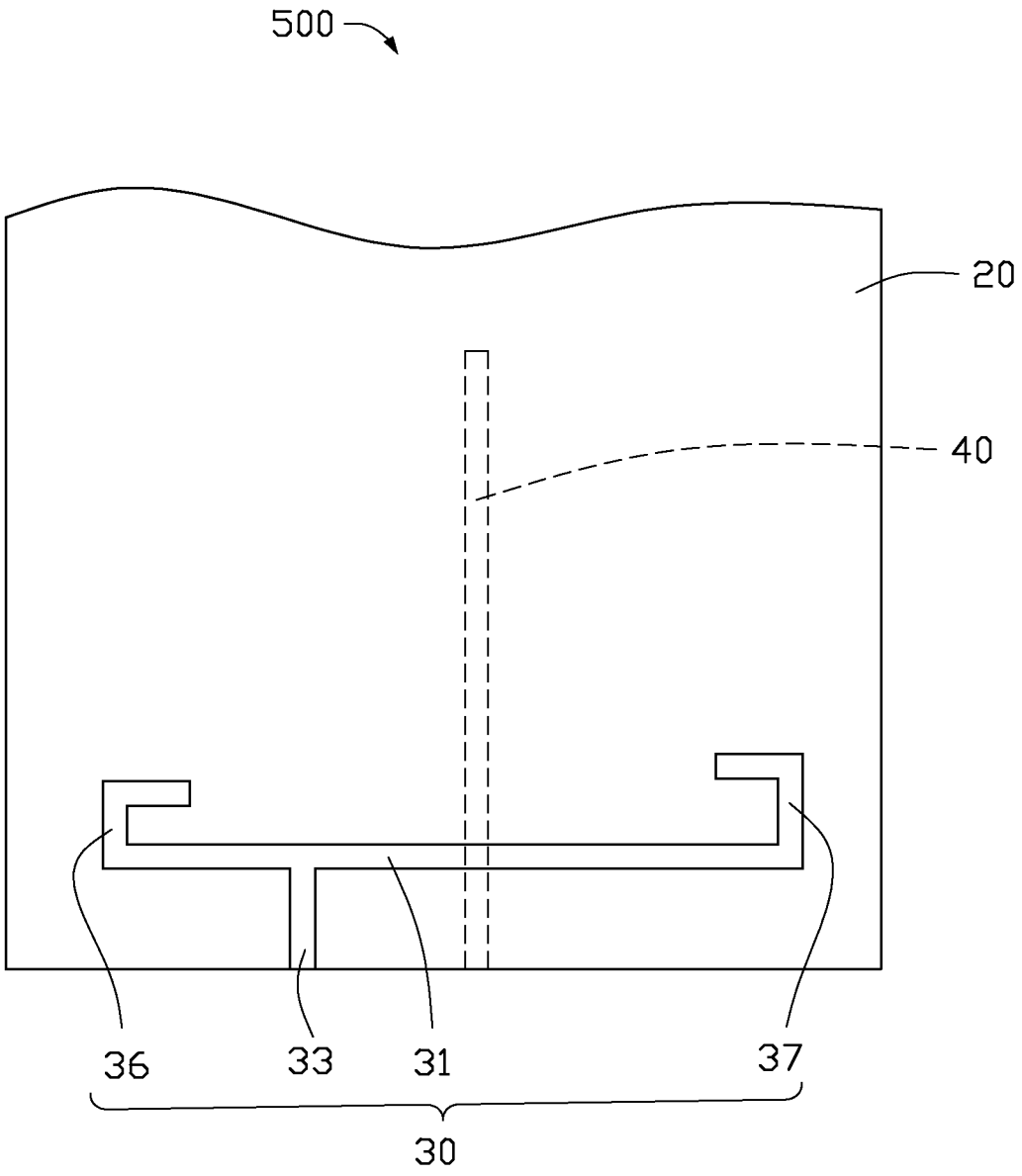
FIG. 9 is a plan view of fifth embodiment of a slot antenna.

FIG. 9 illustrates a plan view of a fifth embodiment of a slot antenna 500. The slot antenna 500 differs from the slot antenna 100 only in that: the slot 30 further includes a third sub-slot 36 and a fourth sub-slot 37 that are coupled to two opposite ends of the first sub-slot 31, respectively. The third and fourth sub-slots 36 and 37 are positioned at a same side of the first sub-slot 31 opposite the second sub-slot 33. The third and fourth sub-slots 36 and 37 are substantially meander slots. In at least one embodiment, the third and fourth sub-slots 36 and 37 are substantially L-shaped.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A slot antenna comprising:

a dielectric substrate having a first surface and a second surface opposite the first surface;

a conductive layer positioned on the first surface, and configured to electronically couple to ground;

a slot defined in the conductive layer and comprising a first sub-slot and a second sub-slot substantially perpendicularly coupled to the first sub-slot, a distal end of the second sub-slot terminating on the edge of the conductive layer; and a feeding strip positioned on the second surface and extending across the slot, and further configured to feed current signal and resonate with the conductive layer;

wherein the feeding strip is substantially perpendicular to the first sub-slot, and a distal end of the feeding strip terminates on an edge of the second surface.

2. The slot antenna of claim 1, wherein the slot further comprises a third sub-slot and a fourth sub-slot that are coupled to two opposite ends of the first sub-slot respectively, the third sub-slot and fourth sub-slot are substantially meander slots.

3. The slot antenna of claim 2, wherein the third sub-slot and fourth sub-slot are substantially L-shaped, and symmetrically located at the two ends of the first sub-slot; the second, third and fourth sub-slots are positioned at a same side of the first sub-slot.

4. The slot antenna of claim 2, wherein the third sub-slot and fourth sub-slot are substantially L-shaped, and symmetrically located at the two ends of the first sub-slot; the third and fourth sub-slots are positioned at a side of the first sub-slot opposite the second sub-slot.

5. The slot antenna of claim 1, wherein the feeding strip is one of a substantially rectangular strip and a substantially L-shaped strip.

6. The slot antenna of claim 1, wherein the feeding strip comprises a first section, a third section, and a second section coupled substantially perpendicular between the first and third sections; the third section is substantially L-shaped.

7. A slot antenna comprising:

a dielectric substrate having a first surface and a second surface opposite the first surface;

a conductive layer positioned on the first surface, and configured to electronically couple to ground;

a slot defined in the conductive layer and having two close-ends and an open-end terminating on an edge of the conductive layer; and a feeding strip positioned on the second surface and extending across the slot, and further configured to feed current signal and resonate with the conductive layer;

wherein the slot comprises a first sub-slot and a second sub-slot substantially perpendicularly coupled to the first sub-slot, a distal end of the second sub-slot terminates on the edge of the conductive layer;

wherein the feeding strip is substantially perpendicular to the first sub-slot, and a distal end of the feeding strip terminates on an edge of the second surface.

8. The slot antenna of claim 7, wherein the slot further comprises a third sub-slot and a fourth sub-slot that are coupled to two opposite ends of the first sub-slot respectively, the third sub-slot and fourth sub-slot are substantially meander slots.

9. The slot antenna of claim 8, wherein the third sub-slot and fourth sub-slot are substantially L-shaped, and symmetrically located at the two ends of the first sub-slot; the second, third and fourth sub-slots are positioned at a same side of the first sub-slot.

10. The slot antenna of claim 8, wherein the third sub-slot and fourth sub-slot are substantially L-shaped, and symmetrically located at the two ends of the first sub-slot; the third and fourth sub-slots are positioned at a side of the first sub-slot opposite the second sub-slot.

11. The slot antenna of claim 8, wherein the feeding strip is one of a substantially rectangular strip and a substantially L-shaped strip.

12. The slot antenna of claim 11, wherein the feeding strip comprises a first section, a third section, and a second section coupled substantially perpendicular between the first and third sections; the third section is substantially L-shaped.

* * * * *